US006409975B1

(12) United States Patent
Seyed-Yagoobi et al.

(10) Patent No.: US 6,409,975 B1
(45) Date of Patent: Jun. 25, 2002

(54) ELECTROHYDRODYNAMIC INDUCTION PUMPING THERMAL ENERGY TRANSFER SYSTEM AND METHOD

(75) Inventors: Jamal Seyed-Yagoobi, College Station, TX (US); Markus Wawzyniak, Stuttgart (DE)

(73) Assignee: The Texas A&M University System, College Station, TX (US)

( * ) Notice: Subject to any disclaimer, the term of this patent is extended or adjusted under 35 U.S.C. 154(b) by 0 days.

(21) Appl. No.: 09/574,007

(22) Filed: May 19, 2000

Related U.S. Application Data

(60) Provisional application No. 60/135,420, filed on May 21, 1999.

(51) Int. Cl.[7] ..... B01J 19/08
(52) U.S. Cl. ..... 422/186; 204/164; 165/96
(58) Field of Search ..... 204/164; 422/186; 165/96

(56) References Cited

U.S. PATENT DOCUMENTS

| | | | | |
|---|---|---|---|---|
| 3,778,678 | A | 12/1973 | Masuda | 317/3 |
| 4,316,233 | A | 2/1982 | Chato et al. | 361/233 |
| 4,651,806 | A | 3/1987 | Allen et al. | 165/1 |
| 5,072,780 | A | 12/1991 | Yabe | 165/1 |
| 5,769,155 | A | 6/1998 | Ohadi et al. | 165/109.1 |

FOREIGN PATENT DOCUMENTS

JP 59134495 A 2/1984

OTHER PUBLICATIONS

Okada and Kanade, A Three–Wheeled Self–Adjusting Vehicle in a Pipe, FERRET–1, The International Journal of Robotics Research, pp. 60–75, vol. 6, No. 4, Winter, 1987.

PCT Search Report, Sep. 11, 2000.

M. Wawzyniak, J. Seyed–Yagoobi, G. L. Morrison; "An Experimental Study of Electrohydrodynamic Induction Pumping of a Stratified Liquid/Vapor Medium;" Proceedings of the 5th ASME/JSME Thermal Engineering Joint Conference; pp. 1–9, Mar. 15–19, 1999.

M. Wawzyniak, J. Seyed–Yagoobi; "An Analytical Study of Electrohydrodynamic Induction Pumping of a Stratified Liquid/Vapor Medium;" IEEE Transaction On Industry Applications; vol. 35, No. 1, pp 1–10, Jan./Feb. 1999.

M. Wawzyniak, J. Seyed–Yagoobi; "An Analytical Study of Electrohydrodynamic Induction Pumping of a Stratified Liquid/Vapor Medium;" Proceedings of Institute of Electrical and Electronics Engineers—Industry Applications Society (IEEE–IAS) Annual Meeting; pp 1879–1886, Oct. 5–9, 1997.

M. Wawzyniak, J. Seyed–Yagoobi; "Electrohydrodynamic Induction Pumping of a Stratified Liquid/Vapor Medium in the Presence of Volumetric and Interface Electric Charges;" Proceedings of IEEE–IAS; pp 1–10, Oct. 1999.

*Primary Examiner*—Kishor Mayekar
(74) *Attorney, Agent, or Firm*—Flynn, Thiel, Boutell & Tanis, P.C.

(57) ABSTRACT

An electrohydrodynamic induction pumping thermal energy transfer system includes an outer conduit and a plurality of inner conduits disposed within the outer conduit. The system also includes a plurality of conductors disposed about a first surface of at least one of the inner conduits. The plurality of conductors is disposed in a spaced apart relationship to each other and extends longitudinally along the inner conduit. The system further includes a power supply coupled to the plurality of conductors. The power supply is operable to induce an electric traveling wave along the first surface of the inner conduit to enhance thermal energy transfer between a fluid disposed within the outer conduit and the inner conduit by inducing longitudinal pumping of a liquid phase of the fluid in contact with the first surface of the inner conduit along the first surface of the inner conduit.

41 Claims, 4 Drawing Sheets

ELECTROHYDRODYNAMIC INDUCTION PUMPING THERMAL ENERGY TRANSFER SYSTEM AND METHOD

RELATED APPLICATIONS

This application claims the benefit of serial number 60/135,420, entitled "System and Method of Electrohydrodynamic Pumping Film," filed provisionally on May 21, 1999.

TECHNICAL FIELD OF THE INVENTION

This invention relates in general to the field of thermal energy transfer and, more particularly, to an electrohydrodynamic induction pumping thermal energy transfer system and method.

BACKGROUND OF THE INVENTION

The promotion of energy conservation and global environmental protection is establishing increased standards for more efficient production and utilization of energy in various industrial and commercial sectors. For example, the introduction of Ozone-safe refrigerants presents new challenges. Not only are the new refrigerants considerably more expensive, but the new refrigerants also generally exhibit poor thermal energy transfer characteristics. Additionally, thermal energy transfer devices, such as heat exchangers, condensers, and evaporators, are generally used to effectively utilize heat energy in a variety of applications. For example, condensers and evaporators may be utilized in refrigeration systems, air conditioning systems, solar energy systems or geothermal energy systems.

One type of thermal energy transfer device may include an outer tube or conduit enclosing a tube bundle or group of smaller diameter inner conduits. In operation, thermal energy transfer occurs between a fluid disposed within the outer conduit and surrounding the inner conduits and a fluid contained within the inner conduits. In the case of a condenser, the fluid entering the outer conduit may be in a vapor phase which is to be condensed into a liquid phase. The condensation into the liquid phase is generally achieved by providing the fluid within the inner conduits at a temperature below a condensing temperature of the vapor.

Present thermal energy transfer devices, however, suffer several disadvantages. For example, in the case of the condenser described above, as the vapor condenses onto the inner conduits, the liquid condensing on the inner conduits disposed near an upper portion of the condenser falls or drips onto inner conduits disposed in a lower portion of the condenser, thereby decreasing the efficiency of thermal energy transfer of the lower inner conduits. Additionally, liquid condensing on the inner conduits prevents additional vapor from being exposed to the inner conduits, thereby also decreasing the efficiency of thermal energy transfer between the outer fluid and the fluid contained within the inner conduits. Also, in an evaporation application, liquid

SUMMARY OF THE INVENTION

The present invention provides an electrohydrodynamic induction pumping thermal energy transfer system and method that addresses shortcomings of prior thermal energy transfer systems and methods. In particular, a thermal energy transfer system and method is provided that utilizes electrohydrodynamic induction fluid movement to increase thermal energy transfer efficiency.

According to one embodiment of the present invention, an electrohydrodynamic induction pumping thermal energy transfer system includes a conduit having a first surface and a second surface. The system also includes a plurality of conductors disposed along the first surface of the conduit. The plurality of conductors are disposed in a spaced apart relationship to each other and extends longitudinally along the conduit. The system further includes a power supply coupled to the plurality of conductors and operable to induce an electric traveling wave along the first surface of the conduit. The electric traveling wave is operable to induce longitudinal pumping of a liquid phase of a fluid in contact with the first surface of the conduit along the first surface of the conduit to enhance thermal energy transfer of the fluid with the conduit.

According to another embodiment of the present invention, a method for electrohydrodynamic induction pumping of a fluid for enhancing thermal energy transfer includes providing a plurality of conductors disposed along a first surface of a conduit. The plurality of conductors are disposed in a spaced apart relationship to each other and extend longitudinally along the conduit. The method also includes coupling a power supply to the plurality of conductors. The method further includes enhancing thermal energy transfer of the fluid with the conduit by inducing a traveling electric wave along the first surface of the conduit using the power supply. The traveling electric wave is operable to induce longitudinal pumping of a liquid phase of the fluid longitudinally along the first surface of the conduit.

Technical advantages of the present invention include providing a more efficient thermal energy transfer system than prior thermal energy transfer systems and methods. In particular, the liquid phase of a fluid is transferred along a surface of a conduit by electrohydrodynamic induction pumping to enhance thermal energy transfer between the fluid and the conduit. For example, in a condenser application, the liquid phase of the fluid is electrohydrodynamically induction pumped along the surface of the conduit. As the liquid phase of the fluid is transferred along the surface of the conduit, a greater volume of the fluid in vapor phase is exposed to the conduit, thereby causing increased condensation. Additionally, electrohydrodynamic pumping of the fluid generates turbulence and vapor entrainment at the interface of the liquid phase and the vapor phase of the fluid, thereby increasing thermal energy transfer.

Another technical advantage of the present invention includes greater thermal energy transfer efficiency throughout a thermal energy transfer device. For example, in the case of a condenser, as the fluid condenses on a surface of a conduit, the liquid phase of the fluid is transferred along the surface of the conduit by electrohydrodynamic induction pumping. Thus, the present invention substantially eliminates the condensed liquid from falling or dripping from upper conduits to lower conduits, thereby increasing the efficiency of the lower conduits.

Other technical advantages of the present invention will be readily apparent to one skilled in the art from the following figures, descriptions and claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
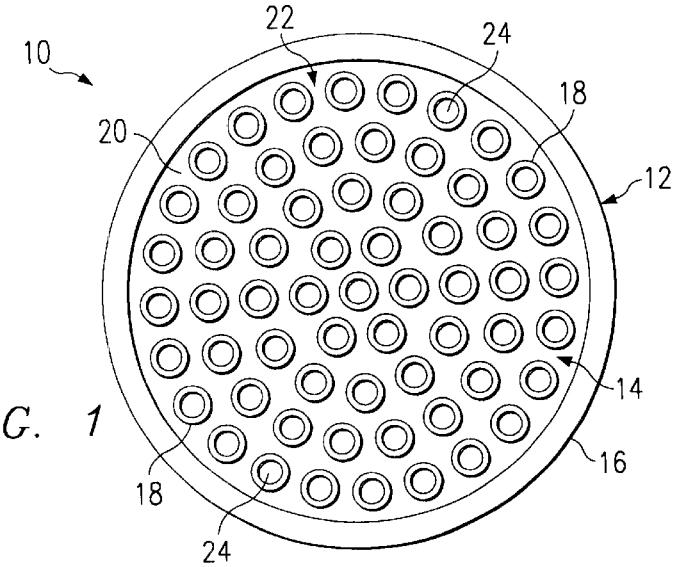
FIG. 1 is a diagram illustrating an electrohydrodynamic induction pumping thermal energy transfer system in accordance with an embodiment of the present invention.

FIG. 1 is a diagram illustrating an electrohydrodynamic induction pumping thermal energy transfer system 10 in accordance with an embodiment of the present invention. System 10 generally comprises a thermal energy transfer device 12 for transferring thermal energy between fluids. Thermal energy transfer device 12 may comprise a condenser, evaporator, heat exchanger or other suitable thermal energy transfer device for transferring thermal energy between fluids.

In the embodiment illustrated in FIG. 1, thermal energy device 12 comprises an inner conduit assembly 14 disposed within an outer tube or conduit 16. Outer conduit 16 may comprise a generally circular configuration; however, it should be understood that other suitable geometric configurations may be used for outer conduit 16. Inner conduit assembly 14 comprises a tube bundle or a collection and/or array of conduits 18. Conduits 18 may comprise a generally circular configuration; however, other suitable geometric configurations may be used for conduits 18. Generally, thermal energy transfer device 12 provides thermal energy transfer between a fluid 20 disposed within an interior region 22 of outer conduit 16 surrounding conduits 18 and a fluid 24 disposed within conduits 18. For example, fluids 20 and 24 may be traveling in opposite directions within thermal energy transfer device 12, and fluid 24 may be at an elevated or reduced temperature relative to a temperature of fluid 20 to cause thermal energy transfer through surfaces of conduits 18.

Figure 2:
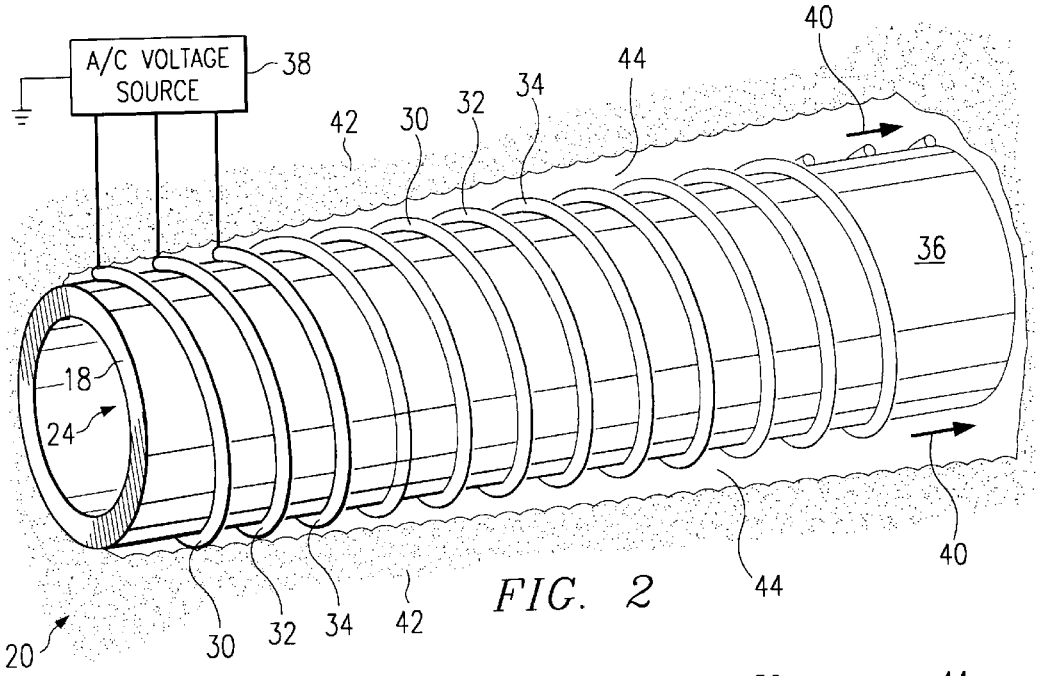
FIG. 2 is a diagram illustrating a close-up view of a conduit of the thermal energy transfer system illustrated in FIG. 1 in accordance with an embodiment of the present invention.

FIG. 2 is a diagram illustrating a close-up view of a single conduit 18 of thermal energy transfer system 10 illustrated in FIG. 1 in accordance with an embodiment of the present invention. In this embodiment, conductors 30, 32 and 34 are disposed on an exterior surface 36 of conduit 18 and extend longitudinally along conduit 18. Conductors 30, 32 and 34 are disposed in a spaced apart relationship to each other and are each coupled to a phase alternating power supply 38. Power supply 38 may be configured to generate a variety of voltage waveforms at various voltage levels and frequencies. For example, power supply 38 may be configured to generate sine, square, and/or triangle voltage waveforms at voltage levels between 0–12 kV (zero to peak) at various fluid-dependent frequencies. However, power supply 38 may be otherwise configured to generate various voltage waveforms at other suitable voltages and frequencies.

In this embodiment, conductors 30, 32 and 34 are spirally wound about conduit 18 such that conductors 30, 32 and 34 extend longitudinally along conduit 18. Conductors 30, 32 and 34 may be constructed from insulated wire or other suitable insulated conducting materials. The spaced apart relationship between conductors 30, 32 and 34 may vary depending on the frequency and voltage level supplied by power supply 38 and the characteristics of the fluid exposed to conductors 30, 32 and 34. For example, in one embodiment, conductors 30, 32 and 34 may be constructed having a width of approximately one millimeter and having a spaced apart relationship relative to each other of approximately ten millimeters. However, other suitable widths and spacing relationships may be used for conductors 30, 32 and 34.

In operation, power supply 38 applies a phase alternating voltage to conductors 30, 32 and 34 to generate a traveling electric field or wave in the direction indicated by arrows 40. In this embodiment, because three conductors 30, 32 and 34 are used, a three-phase alternating voltage is applied to conductors 30, 32 and 34. For example, the voltages applied to each conductor 30, 32 and 34 may be approximately one hundred twenty degrees out-of-phase from an adjacent conductor 30, 32 and 34, thereby generating a voltage or polarity electric charge differential between adjacent conductors 30, 32 and 34. In the embodiment illustrated in FIG. 2, three conductors 30, 32 and 34 are used to generate a traveling electric wave along conduit 18. However, it should be understood that two or more conductors may be used for generating the traveling electric wave. Correspondingly, power supply 38 may be configured to supply multiple-phase alternating voltages to the conductors corresponding to the quantity of conductors to generate a voltage or polarity electric charge differential between adjacent conductors to produce the traveling electric wave for electrohydrodynamic induction pumping.

In this embodiment, thermal energy transfer device 12 comprises a condenser for external condensation of fluid 20 relative to conduit 18. For example, fluid 20 may enter outer conduit 16 and surround conduits 18 in a vapor phase 42. Fluid 20 generally comprises a dielectric fluid to facilitate generating the electric fields using conductors 30, 32 and 34. Fluid 20 may comprise refrigerants/refrigerant mixtures, cryogenic fluids, hydrocarbons/hydrocarbon derivatives, or aviation fuel. However, other suitable dielectric fluids may also be used for fluid 20 to accommodate electrohydrodynamic induction pumping of fluid 20. In this embodiment, fluid 24 disposed within conduits 18 is supplied at a temperature below a condensing temperature of fluid 20 and acts as a cooling medium to cause a liquid phase 44 of fluid 20 to condense or form on exterior surface 36 of conduit 18.

As liquid phase 44 of fluid 20 forms on exterior surface 36 of conduit 18, the traveling electric wave generated by power supply 38 and conductors 30, 32 and 34 causes movement, by electrohydrodynamic induction pumping, of liquid phase 44 along conduit 18 in the direction indicated by arrows 40. As liquid phase 44 of fluid 20 travels longitudinally along exterior surface 36 of conduit 18, additional volumes or amounts of vapor phase 42 of fluid 20 are exposed to exterior surface 36 of conduit 18, thereby increasing the amount of condensation of fluid 20. Additionally, electrohydrodynamic induction pumping of liquid phase 44 of fluid 20 generates turbulence and vapor entrainment at the interface between vapor phase 42 and liquid phase 44, thereby increasing the thermal energy transfer.

Thus, the present invention provides greater efficiency than prior thermal energy transfer systems by using electrohydrodynamic induction pumping to enhance thermal energy transfer between fluids 20 and 24. Additionally, the present invention provides greater flexibility than prior thermal energy transfer systems by allowing thermal energy transfer modification to various portions of thermal energy transfer device 12.

For example, although all conduits 18 within outer conduit 16 may be constructed as illustrated in FIG. 2, it should also be understood that only a portion of conduits 18 of inner conduit assembly 14 may be configured as illustrated in FIG. 2 to accommodate various thermal energy transfer characteristics. For example, in the case of an external condenser as illustrated in FIG. 2, thermal energy transfer device 12 may be constructed having only conduits 18 disposed in an upper portion of outer conduit 16 configured as illustrated in FIG. 2. Thus, liquid phase 44 forming on exterior surface 36 of conduits 18 located in the upper portion of outer conduit 16 is substantially prevented from falling or dripping onto conduits 18 disposed in a lower portion of outer conduit 16, thereby increasing the thermal energy transfer efficiency of the lower-disposed conduits 18 while decreasing costs associated with construction and operation of thermal energy transfer device 12. Additionally, for example, conduits 18 may be constructed having conductors 30, 32 and 34 extending longitudinally along an entire length of conduit 18 or extending along only a portion of the length of conduit 18 to accommodate various thermal energy transfer characteristics. Therefore, the present invention provides greater flexibility than prior thermal energy transfer systems by accommodating a variety of thermal energy transfer design configurations.

Additionally, the present invention may be configured to accommodate a generally long or extended length of conduit 18 by incorporating two sets of conductors 30, 32 and 34, each set of conductors 30, 32 and 34 used to induce a traveling electric wave in opposite directions relative to an intermediate point of conduit 18. For example, each set of conductors 30, 32 and 34 may be positioned to originate at an intermediate point of conduit 18 and travel longitudinally along conduit 18 in opposite directions such that one set of conductors 30, 32 and 34 induces longitudinal electrohydrodynamic induction pumping of liquid phase 44 in the direction indicated by arrows 40 while the other set of conductors 30, 32 and 34 is used to induce longitudinal electrohydrodynamic induction pumping of liquid phase 44 in a direction opposite that indicated by arrows 40. Thus, the present invention may be configured to accommodate a variety of induction pumping thermal energy transfer characteristics.

Figure 3:
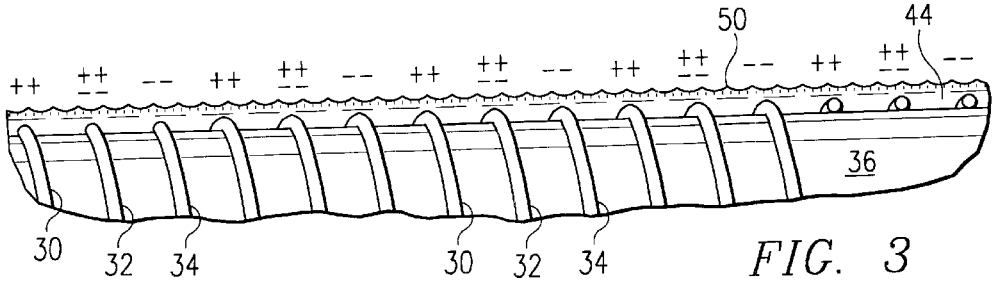
FIG. 3 is a diagram illustrating an electrical charge differential induced in a fluid disposed about the conduit illustrated in FIG. 2 by electrohydrodynamic induction in accordance with an embodiment of the present invention.

FIG. 3 is a diagram illustrating an electrical charge differential generated at a boundary surface 50 of liquid phase 44 on conduit 18 in accordance with an embodiment of the present invention. In operation, power supply 38 applies the three-phase alternating current to conductors 30, 32 and 34 to generate the traveling electric wave along exterior surface 36 of conduit 18 for electrohydrodynamic induction pumping of liquid phase 44. Electrostatic charges within liquid phase 44 and at boundary surface 50 of liquid phase 44 acts to attract or repel dissimilar charges, thereby causing movement of liquid phase 44 in a particular direction. For example, as illustrated in FIG. 3, at a particular moment in time, conductor 30 includes a generally positive charge, conductor 34 includes a generally negative charge, and conductor 32 includes a generally neutral charge relative to conductors 30 and 34. The charge or polarity differential within liquid phase 44 and at boundary surface 50 of liquid phase 44 causes movement of liquid phase 44 in the same or opposite direction with respect to the direction of the traveling electric wave.

Figure 4:
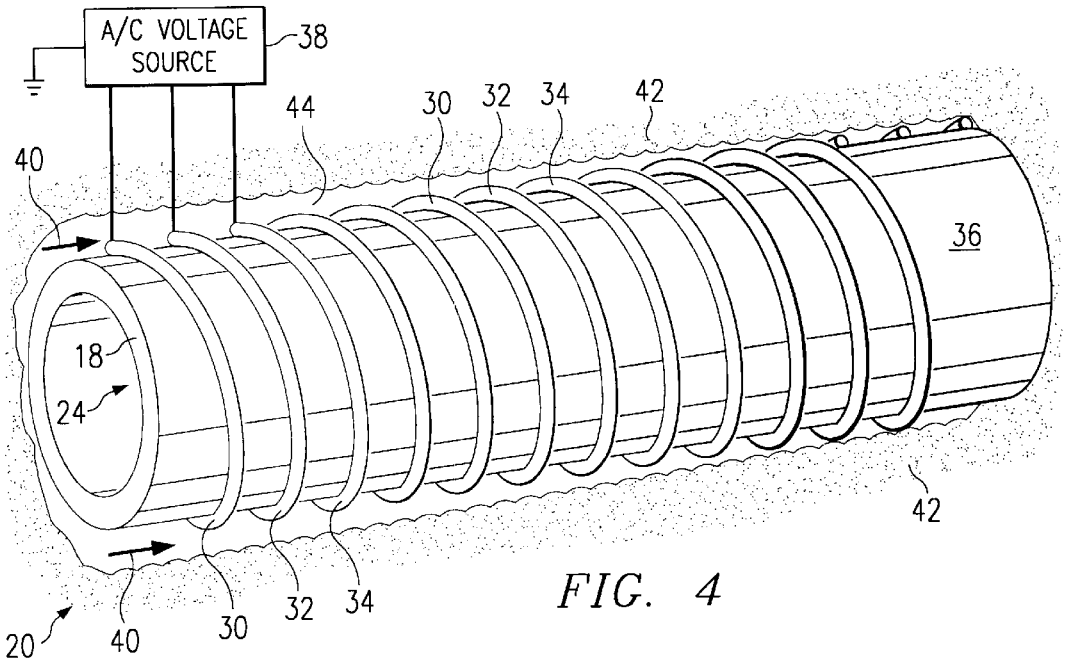
FIG. 4 is a diagram illustrating a close-up view of a conduit of the thermal energy transfer system illustrated in FIG. 1 in accordance with an another embodiment of the present invention.

FIG. 4 is a diagram illustrating a close-up view of conduit 18 in accordance with an another embodiment of the present invention. In this embodiment, thermal energy transfer system 10 comprises an evaporator for external evaporation of liquid phase 44 from exterior surface 36 of conduit 18. As illustrated in FIG. 4, conductors 30, 32 and 34 are spirally wound about exterior surface 36 of conduit 18 and extend longitudinally along conduit 18. Power supply 38 is coupled to conductors 30, 32 and 34 to generate an electric traveling wave along conduit 18 in the direction indicated by arrows 40 to induce electrohydrodynamic induction pumping of liquid phase 44 along exterior surface 36.

In operation, fluid 20 enters interior region 22 of outer conduit 16 in liquid phase 44, and liquid phase 44 is evaporated into vapor phase 42 from exterior surface 36 of conduit 18. For example, fluid 24 disposed within conduit 18 may be provided at a temperature greater than an evaporation temperature of fluid 20, thereby acting as a heating medium to cause evaporation of liquid phase 44 resulting from thermal energy transfer between fluids 20 and 24.

By transferring liquid phase 44 along exterior surface 36 of conduit 18, thermal energy transfer system 10 provides greater efficiency than prior thermal energy transfer systems. For example, movement of liquid phase 44 along conduit 18 exposes a greater amount or volume of liquid phase 44 to exterior surface 36 of conduit 18, thereby causing increased evaporation of liquid phase 44. Additionally, as described above, electrohydrodynamic induction pumping of liquid phase 44 generates turbulence and vapor entrainment at boundary surface 50 of liquid phase 44 and vapor phase 42, thereby increasing thermal energy transfer. Electrohydrodynamic induction pumping of liquid phase 44 along exterior surface 36 of conduit 18 also substantially prevents liquid phase 44 from falling or dripping onto other conduits 18 within outer conduit 16.

Figure 5:
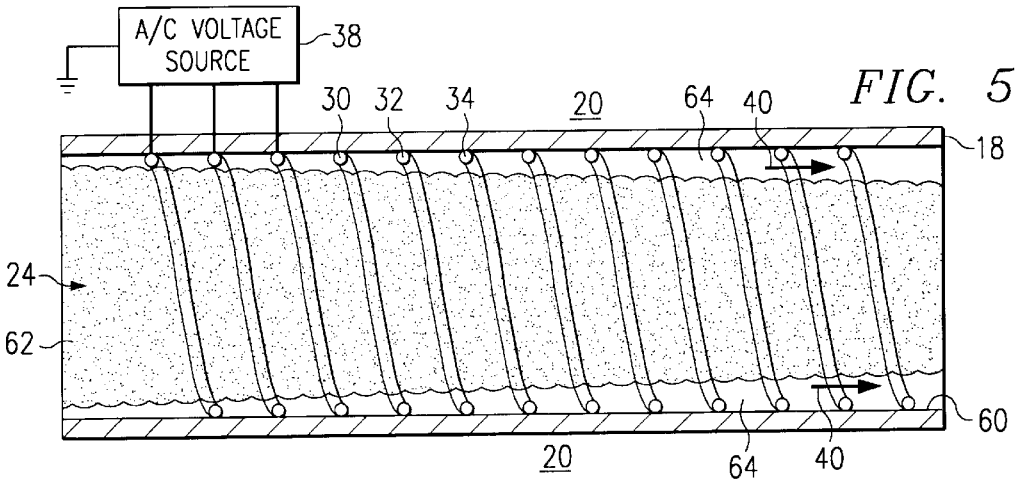
FIG. 5 is a diagram illustrating a close-up view of a conduit of the thermal energy transfer system illustrated in FIG. 1 in accordance with an another embodiment of the present invention.

FIG. 5 is a diagram illustrating a close-up view of conduit 18 in accordance with an another embodiment of the present invention. In this embodiment, thermal energy transfer system 10 comprises an internal condenser. For example, as illustrated in FIG. 5, conductors 30, 32 and 34 are disposed on an interior surface 60 of conduit 18. Conductors 30, 32 and 34 are disposed in a spaced apart relationship to each other and extend longitudinally within conduit 18. In this embodiment, conductors 30, 32 and 34 are spirally wound within conduit 18 and extend longitudinally within conduit 18. Power supply 38 is coupled to conductors 30, 32 and 34 for providing a three-phase alternating voltage to conductors 30, 32 and 34 for generating an electric traveling wave along interior surface 60 of conduit 18 in the direction indicated by arrows 40.

In operation, fluid 24 enters conduit 18 in a vapor phase 62 and is condensed to a liquid phase 64 on interior surface 60 of conduit 18. For example, fluid 20 surrounding conduit 18 may be provided at a temperature less than a condensing temperature of fluid 24, thereby acting a cooling medium to cause condensation of fluid 24 on interior surface 60. In this embodiment, fluid 24 generally comprises a dielectric fluid to facilitate generating the electric fields using conductors 30, 32 and 34. Fluid 24 may comprise refrigerants/refrigerant mixtures, cryogenic fluids, hydrocarbons/hydrocarbon derivatives, or aviation fuel. However, other suitable dielectric fluids may also be used for fluid 24 to accommodate electrohydrodynamic induction pumping of fluid 24.

The electric traveling wave generated by power supply 38 and conductors 30, 32 and 34 transfer liquid phase 64 longitudinally along interior surface 60 of conduit 18 by electrohydrodynamic induction pumping to enhance thermal energy transfer between fluid 24 and interior surface 60 of conduit 18. For example, movement of liquid phase 64 along interior surface 60 provides increased exposure of additional amounts or volumes of vapor phase 62 to interior surface 60 such that increased condensation of fluid 24 occurs. Additionally, as described above, electrohydrodynamic induction pumping of liquid phase 44 generates turbulence and vapor entrainment at boundary surface 50 of liquid phase 44 and vapor phase 42, thereby increasing thermal energy transfer. Thus, the present invention provides greater efficiency than prior thermal energy transfer systems and methods by increasing thermal energy transfer between fluid 20 and fluid 24 using electrohydrodynamic induction pumping.

Figure 6:
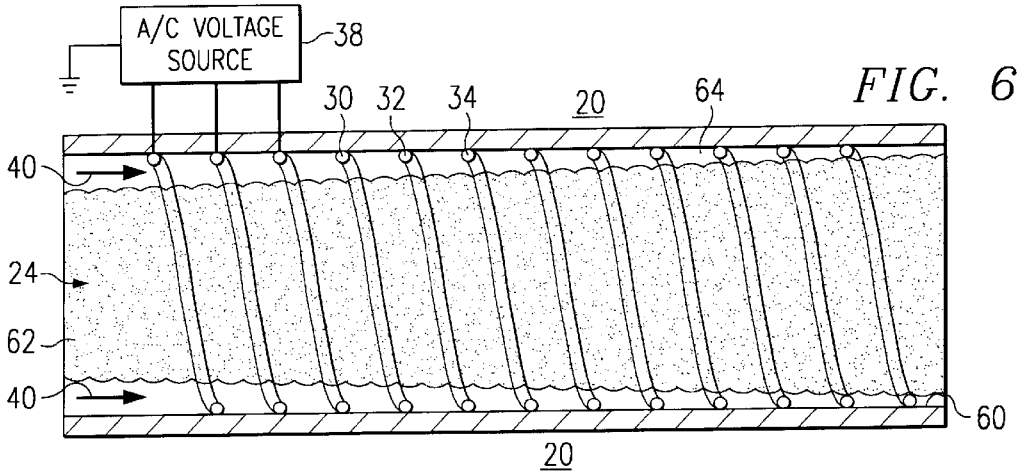
FIG. 6 is a diagram illustrating a close-up view of a conduit of the thermal energy transfer system illustrated in FIG. 1 in accordance with an another embodiment of the present invention.

FIG. 6 is a diagram illustrating a close-up view of conduit 18 in accordance with another embodiment of the present invention. In this embodiment, thermal energy transfer system 10 comprises an evaporator for internal evaporation of fluid 24 within conduit 18. For example, as illustrated in FIG. 6, conductors 30, 32 and 34 are disposed on interior surface 60 of conduit 18 in a spaced apart relationship to each other and extending longitudinally along conduit 18. In this embodiment, conductors 30, 32 and 34 are spirally wound about interior surface 60 and extend longitudinally along interior surface 60. Power supply 38 is coupled to conductors 30, 32 and 34 for providing a three-phase alternating voltage to conductors 30, 32 and 34 for generating an electric traveling wave along interior surface 60 of conduit 18 in the direction indicated by arrows 40.

In operation, fluid 24 enters conduit 18 in liquid phase 64 and is evaporated into vapor phase 62 resulting from thermal energy transfer between fluids 20 and 24. For example, fluid 20 surrounding conduit 18 may be provided at a temperature greater than an evaporation temperature of fluid 24, thereby acting as a heating medium to cause evaporation of liquid phase 64 of fluid 24 resulting from thermal energy transfer between liquid phase 64 and interior surface 60 of conduit 18.

Thermal energy transfer system 10 provides greater efficiency than prior thermal energy transfer systems by increasing the amount or volume of liquid phase 64 of fluid 24 exposed to interior surface 60 of conduit 18 to increase thermal energy transfer between fluids 20 and 24 and, correspondingly, evaporation of liquid phase 64. For example, generating the electric traveling wave along interior surface 60 of conduit 18 causes movement of liquid phase 64 longitudinally along interior surface 60, thereby increasing the amount or volume of liquid phase 64 exposed to interior surface 60 to increase thermal energy transfer between interior surface 60 and liquid phase 64. Additionally, as described above, electrohydrodynamic induction pumping of liquid phase 44 generates turbulence and vapor entrainment at boundary surface 50 of liquid phase 44 and vapor phase 42, thereby increasing thermal energy transfer.

Figure 7:
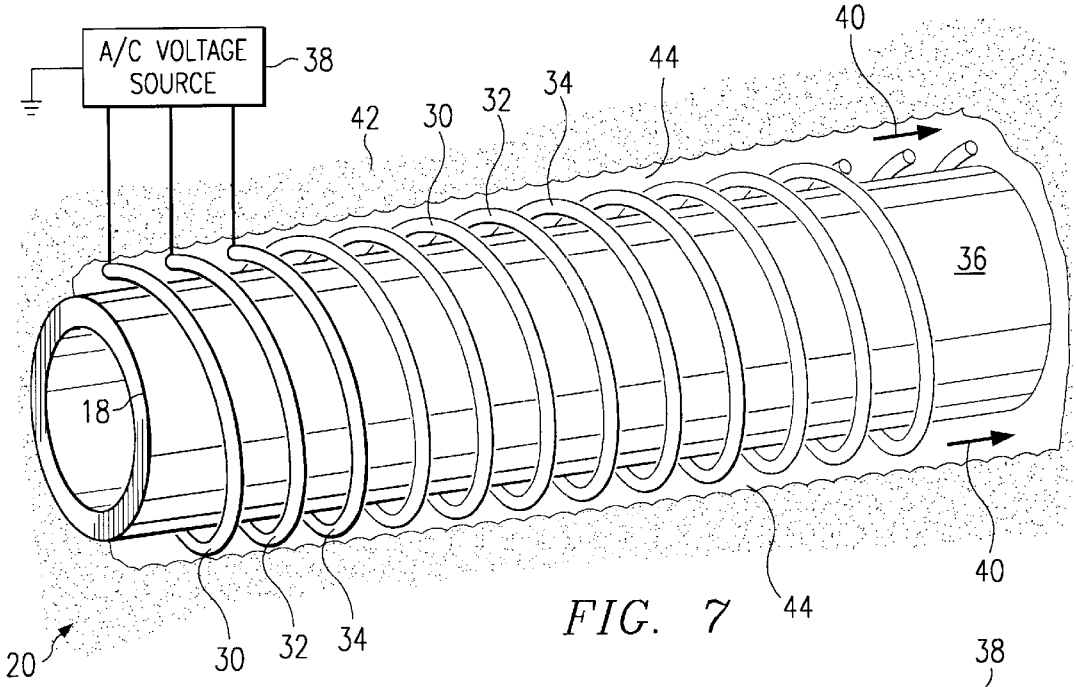
FIG. 7 is a diagram illustrating a close-up view of a conduit of the thermal energy transfer system illustrated in FIG. 1 in accordance with an another embodiment of the present invention.

FIG. 7 is a diagram illustrating a close-up view of conduit 18 in accordance with another embodiment of the present invention. In this embodiment, conductors 30, 32 and 34 are disposed at a spaced apart relationship relative to conduit 18 and extend longitudinally along conduit 18. For example, conductors 30, 32 and 34 may be disposed spaced apart from exterior surface 36 of conduit 18 by approximately 2–3 millimeters. However, other suitable spacing relationships for conductors 30, 32 and 34 relative to exterior surface 36 may be used.

In this embodiment, conductors 30, 32 and 34 may be constructed from non-insulated wire or other suitable non-insulated conducting materials. In operation, conductors 30, 32 and 34 are disposed in close proximity to exterior surface 36 for generating the electric traveling wave along conduit 18. For example, conductors 30, 32 and 34 may be disposed at a spaced apart relationship relative to exterior surface 36 such that conductors 30, 32 and 34 are in contact with or in close proximity to liquid phase 44 of fluid 20 for electrohydrodynamic induction pumping of liquid phase 44 longitudinally along exterior surface 36 of conduit 18. It should be understood that conductors 30, 32 and 34 may also be disposed within conduit 18 in a spaced apart relationship relative to interior surface 60 of conduit 18.

Figure 8:
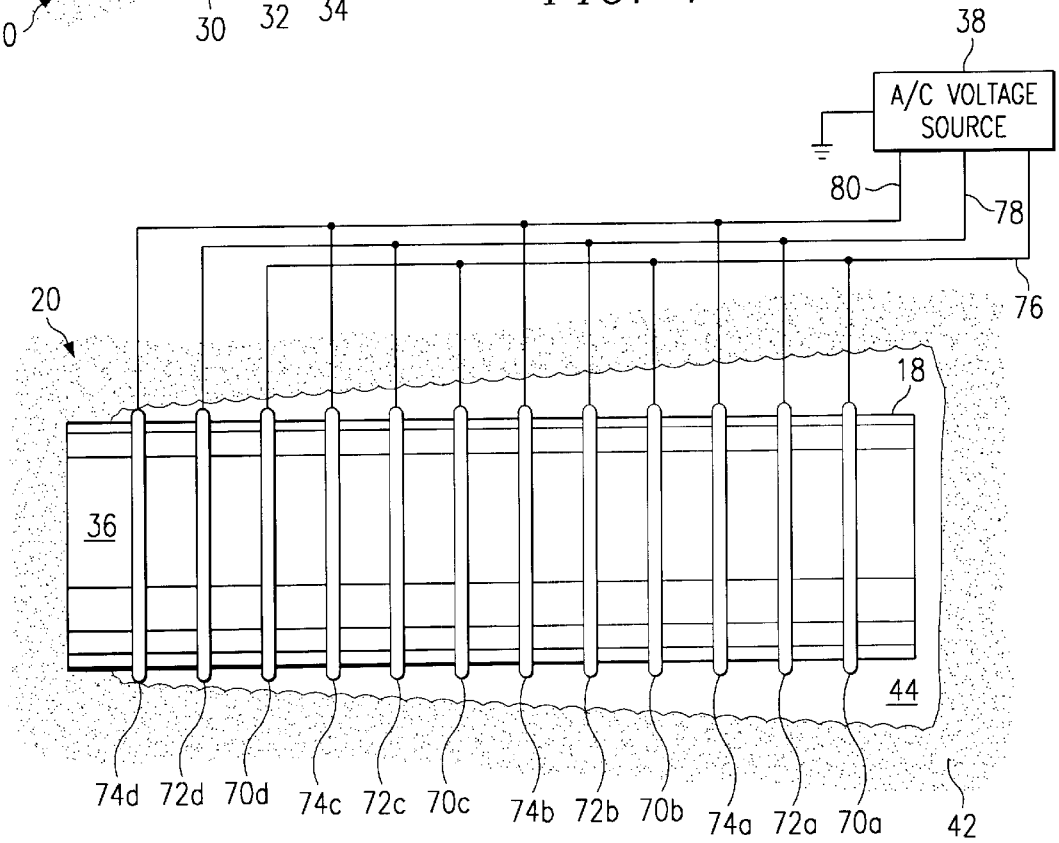
FIG. 8 is a diagram illustrating a close-up view of a conduit of the thermal energy transfer system illustrated in FIG. 1 in accordance with an another embodiment of the present invention.

FIG. 8 is a diagram illustrating a close-up view of conduit 18 in accordance with another embodiment of the present invention. In this embodiment, conductors 70*a* though 70*d*, 72*a* through 72*d*, and 74*a* through 74*d* are disposed about conduit 18. As illustrated in FIG. 8, conductors 70, 72 and 74 may comprise insulated conductor rings disposed in contact with exterior surface 36 of conduit 18. However, it should be understood that conductors 70, 72 and 74 may also be disposed about in interior region of conduit 18 as best illustrated in FIGS. 5 and 6. Additionally, conductors 70, 72 and 74 may be disposed spaced apart from exterior surface 36 or interior surface 60 of conduit 18, as best illustrated in FIG. 7.

Referring to FIG. 8, conductors 70, 72 and 74 are disposed in a spaced apart relationship to each other and extend longitudinally along conduit 18. Each conductor 70, 72 and 74 is coupled to power supply 38 for generating an electric traveling wave along conduit 18 to cause longitudinal induction pumping of liquid phase 44 along conduit 18. For example, in this embodiment, power supply 38 may be configured to provide a three-phase alternating voltage to conductors 70, 72 and 74 to generate a voltage or polarity electric charge differential between adjacent conductors 70, 72 and 74. Thus, to generate the electric charge differential, conductors 70*a* through 70*d* are coupled to power supply 38 through a lead 76, conductors 72*a* through 72*d* are coupled to power supply 38 through a lead 78, and conductors 74*a* through 74*d* are coupled to power supply 38 through a lead 80. Therefore, the three-phase alternating voltages may be applied to conductors 70, 72 and 74 using leads 76, 78 and 80, respectively, to generate the traveling electric wave. However, it should be understood that power supply 38 may be configured to provide multiple-alternating phase voltages coupled to a corresponding multiple of conductors for generating electrohydrodynamic induction pumping of liquid phase 44.

Figure 9:
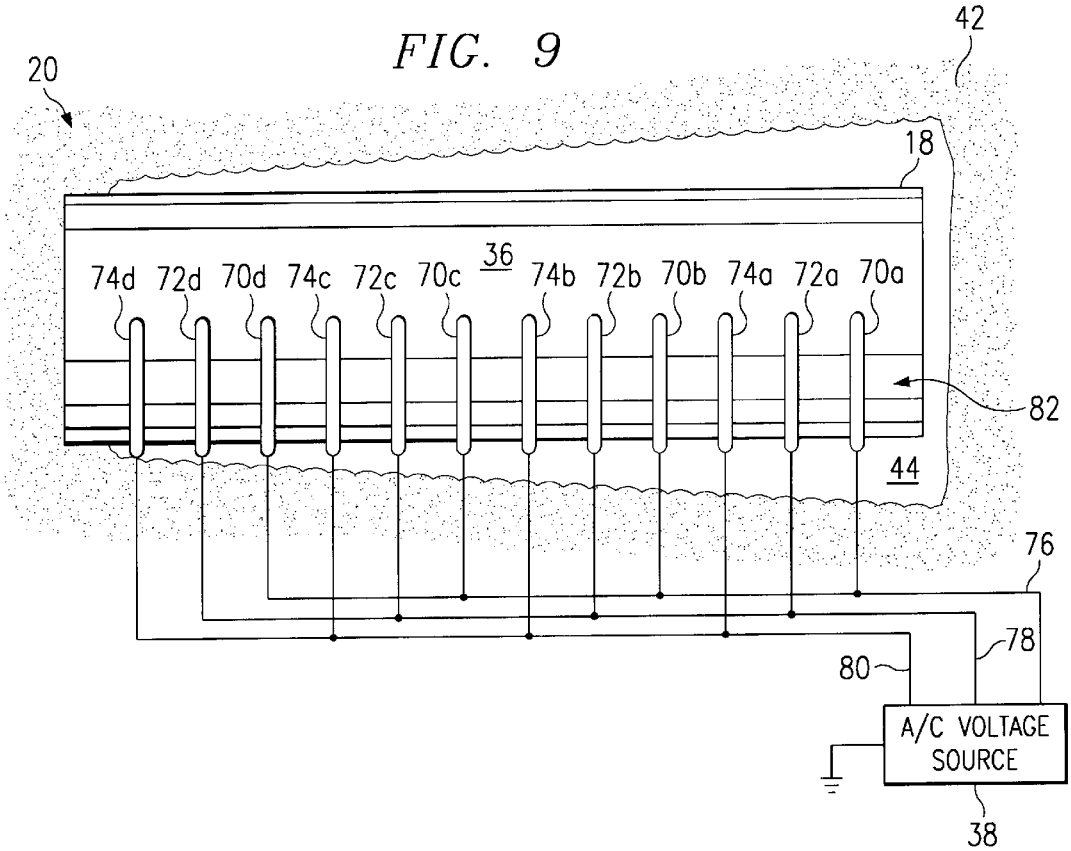
FIG. 9 is a diagram illustrating a close-up view of a conduit of the thermal energy transfer system illustrated in FIG. 1 in accordance with an another embodiment of the present invention.

As described above, conductors 70, 72 and 74 may be configured to extend longitudinally along an entire length of conduit or may be configured to extend longitudinally along a portion of the length of conduit 18. Additionally, as illustrated in FIG. 8, conductors 70, 72 and 74 may be configured to extend circumferentially about conduit 18. However, conductors 70, 72 and 74 may also be configured to extend about a portion of the circumference of conduit 18 as illustrated in FIG. 9. In this embodiment, conductors 70, 72 and 74 comprise insulated conductor rings disposed in contact with exterior surface 36 of conduit 18 and extending about a portion of the circumference of conduit 18. For example, conductors 70, 72 and 74 may comprise semicircular configured conductor rings coupled to exterior surface 36 of conduit 18 such that conductors 70, 72 and 74 are disposed about a lower portion 82 of conduit 18. However, conductors 70, 72 and 74 may be positioned about other various portions of conduit 18, including the interior or exterior of conduit 18, to accommodate a variety of electrohydrodynamic induction pumping applications along conduit 18. Thus, in the embodiment illustrated in FIG. 9, for an external condensation application, liquid phase 44 of fluid 20 condensing on exterior surface 38 of conduit 18 is electrohydrodynamically induction pumped longitudinally along conduit 18 to substantially prevent liquid phase 44 from dripping from lower portion 82 of conduit 18 onto other conduits 18.

Therefore, the present invention provides greater efficiency than prior thermal energy transfer systems by using electrohydrodynamic induction pumping to enhance thermal energy transfer. For example, as described above, movement of a liquid phase of a fluid along a conduit causes an increase in the volume of fluid in contact with thermal energy transfer surfaces, thereby increasing the thermal energy transfer between the fluid and corresponding thermal energy transfer surface. Additionally, movement of the liquid phase along conduits 18 substantially prevents liquid phase 44 disposed on exterior surfaces 36 of conduits 18 from falling or dripping onto other conduits 18, thereby increasing thermal energy transfer efficiency.

Although the present invention and its advantages have been described in detail, it should be understood that various changes, substitutions and alterations can be made therein without departing from the spirit and scope of the present invention as defined by the appended claims.

What is claimed:

1. In a thermal energy transfer system comprising a heat transfer member having separate first and second surfaces each being configured to be subjected to separate first and second temperatures, at least one of the first and second surfaces also being configured to be subjected to a fluid so that a liquid phase of the fluid is present on the at least one of the first and second surfaces, the improvement comprising:

a plurality of separate electrical conductors disposed in a spaced apart relationship to each other and extending longitudinally along the first surface of the heat transfer member; and an electric multi-phase alternating power source having multiple terminals and configured to produce a number of phases corresponding to a number of the multiple terminals, each of the plural electrical multiple conductors being connected to a different one of the multiple terminals to cause an electric traveling wave to move in a longitudinal direction of the heat transfer member to induce pumping of at least the liquid phase in the longitudinal direction to thereby enhance the thermal energy transfer characteristics of the thermal energy transfer system.

2. The system of claim 1, wherein the longitudinal direction is additionally perpendicular to a longitudinal axis of the electrical conductors.

3. The system of claim 1, wherein the plurality of electrical conductors are spirally wound about the heat transfer member.

4. The system of claim 1, wherein the plurality of electrical conductors comprises a plurality of electrical conductor rings disposed in a spaced apart relationship to each other and in parallel planes oriented transverse to the longitudinal axis of the heat transfer member.

5. The system of claim 1, wherein the first surface of the heat transfer member comprises an exterior surface of the heat transfer member and the second surface of the heat transfer member comprises an interior surface of the heat transfer member, and wherein a cooling medium is disposed in contact with the interior surface, and wherein longitudinal pumping of at least the liquid phase along the exterior surface of the heat transfer member enhances condensation of the liquid phase on the exterior surface of the heat transfer member.

6. The system of claim 1, wherein the power supply is operable to induce a polarity of electric charge differential at a boundary surface between the liquid phase and a vapor phase of the fluid, the polarity differential operable to cause longitudinal pumping of the liquid phase along the at least one of the first and second surfaces of the heat transfer member.

7. The system of claim 1, wherein the power supply is operable to supply a phase varying voltage to each of the plurality of electrical conductors to induce longitudinal pumping of the liquid phase along the axial length of the heat transfer member.

8. The system of claim 1, wherein the first surface of the heat transfer member comprises an interior surface of the heat transfer member and the second surface of the heat transfer member comprises an exterior surface of the heat transfer member, and wherein a cooling medium is disposed in contact with the exterior surface, and wherein longitudinal pumping of the liquid phase along the interior surface of the heat transfer member enhances condensation to form the liquid phase on the interior surface of the heat transfer member.

9. The system of claim 1, wherein the first surface of the heat transfer member comprises an interior surface of the heat transfer member and the second surface of the heat transfer member comprises an exterior surface of the heat transfer member, and wherein a heating medium is disposed in contact with the exterior surface, and wherein longitudinal pumping of the liquid phase along the interior surface of the heat transfer member facilitates vaporization of the liquid phase on the interior surface of the heat transfer member.

10. The system of claim 1, wherein the plurality of electrical conductors comprises a plurality of insulated electrical conductors, and wherein the plurality of insulated electrical conductors are disposed in contact with the first surface of the heat transfer member.

11. The system of claim 1, wherein the plurality of electrical conductors are disposed in a spaced apart relationship relative to the first surface of the heat transfer member.

12. The system of claim 1, wherein the plurality of electrical conductors comprises:

a first set of electrical conductors disposed in a spaced apart relationship relative to each other and extending longitudinally in a first direction along the heat transfer member; and a second set of electrical conductors disposed in a spaced apart relationship relative to each other and extending longitudinally in a second direction along the heat transfer member, the second direction being substantially opposite the first direction; and wherein the power supply is operable to induce longitudinal pumping of the liquid phase along the first surface of the heat transfer member in the first and second directions.

13. The system of claim 1, wherein the first surface of the heat transfer member comprises an exterior surface of the heat transfer member and the second surface of the heat transfer member comprises an interior surface of the heat transfer member, and wherein a heating medium is disposed in contact with the interior surface, and wherein longitudinal pumping of the liquid phase along the exterior surface of the heat transfer member enhances vaporization of the liquid phase on the exterior surface of the heat transfer member.

14. The system of claim 1, wherein the heat transfer member is constructed having a substantially circular cross sectional configuration, and wherein the electrical conductors are disposed at least about a portion of a circumference of the heat transfer member.

15. In a thermal energy transfer system comprising a heat transfer member having separate first and second surfaces each being configured to be subjected to separate first and second temperatures, at least one of the first and second surfaces also being configured to be subjected to a fluid so that a liquid phase of the fluid is present on the at least one of the first and second surfaces, the improved method comprising:

providing a plurality of separate electrical conductors extending coextensively with an axial length of the heat transfer member and at least partially around the circumference thereof;

providing an electric multi-phase alternating power source having multiple terminals and producing a number of phases corresponding to a number of the multiple terminals;

coupling each of the multiple electrical conductors to a different one of the multiple terminals so that an electric traveling wave moves in a longitudinal direction of the heat transfer member to induce pumping of at least the liquid phase in the longitudinal direction to thereby enhance the thermal energy transfer characteristics of the thermal energy transfer system.

16. The method of claim 15, wherein the longitudinal direction is additionally perpendicular to a longitudinal axis of the electrical conductors.

17. The method of claim 15, wherein providing the plurality of electrical conductors comprises providing the plurality of electrical conductors spirally wound about the first surface of the heat transfer member.

18. The method of claim 15, wherein inducing the traveling electric wave comprises supplying a phase varying voltage to each of the plurality of electrical conductors, the phase varying voltage inducing a polarity differential in the fluid to induce longitudinal pumping of at least the liquid phase along the at least one of the first and second surfaces of the heat transfer member.

19. The method of claim 15, wherein providing the plurality of electrical conductors comprises providing the plurality of electrical conductors disposed on an exterior surface of the heat transfer member, and further comprising disposing a cooling medium in contact with an interior surface of the heat transfer member, and wherein enhancing thermal energy transfer comprises enhancing condensation of the liquid on the exterior surface of the heat transfer member by inducing longitudinal pumping of at least the liquid phase along the exterior surface of the heat transfer member.

20. The method of claim 15, wherein providing the plurality of electrical conductors comprises providing the plurality of electrical conductors disposed on an interior surface of the heat transfer member, and further comprising disposing a cooling medium in contact with an exterior surface of the heat transfer member, and wherein enhancing thermal energy transfer comprises enhancing condensation of the liquid on the interior surface of the heat transfer member by inducing longitudinal pumping of at least the liquid phase along the interior surface of the heat transfer member.

21. The method of claim 15, wherein providing the plurality of electrical conductors comprises providing the plurality of electrical conductors disposed on an interior surface of the heat transfer member, and further comprising disposing a heating medium in contact with an exterior surface of the heat transfer member, and wherein enhancing thermal energy transfer comprises enhancing evaporation of the liquid on the interior surface of the heat transfer member by inducing longitudinal pumping of at least the liquid phase along the interior surface of the heat transfer member.

22. The method of claim 15, wherein providing the plurality of electrical conductors comprises providing the plurality of electrical conductors disposed on an exterior surface of the heat transfer member, and further comprising disposing a heating medium in contact with an interior surface of the heat transfer member, and wherein enhancing thermal energy transfer comprises enhancing vaporization of the liquid on the exterior surface of the heat transfer member by inducing longitudinal pumping of the liquid phase along the exterior surface of the heat transfer member.

23. The method of claim 15, wherein providing the plurality of electrical conductors comprises providing the plurality of electrical conductors disposed in a radially spaced apart relationship relative to the first surface of the heat transfer member.

24. The method of claim 15, wherein providing the plurality of electrical conductors comprises providing a plurality of insulated electrical conductors disposed in contact with the first surface of the heat transfer member.

25. The method of claim 15, wherein providing the plurality of electrical conductors comprises providing a first electrode, a second electrode and a third electrode disposed along the first surface of the heat transfer member in a spaced apart relationship to each other, and wherein inducing movement of at least the liquid phase comprises providing a voltage to each of the first, second and third electrodes, the voltage provided to each of the first, second and third electrodes being approximately 120 degrees out-of-phase from an adjacent electrode.

26. The method of claim 15, wherein providing the plurality of electrical conductors comprises providing a plurality of electrical conductor rings disposed in a spaced apart relationship to each other and in parallel planes oriented transverse to the longitudinal axis of the heat transfer member.

27. The method of claim 26, wherein providing the plurality of electrical conductor rings comprises providing the plurality of electrical conductor rings which each extend entirely around the circumference of the heat transfer member.

28. In a thermal energy transfer system comprising plural heat transfer members each having separate first and second surfaces each being configured to be subjected to separate first and second temperatures, at least one of the first and second surfaces also being configured to be subjected to a fluid so that a liquid phase of the fluid is present on the at least one of the first and second surfaces, and an outer conduit in which is oriented the plural heat transfer members, wherein the improvement comprises:

a plurality of electrical conductors disposed about the first surface of at least one of the heat transfer members, the plurality of electrical conductors being disposed in a spaced apart relationship to each other and extending coextensively with an axial length of the at least one heat transfer member; and an electric multi-phase alternating power source having multiple terminals and configured to produce a number of phases corresponding to a number of the multiple terminals, each of the plural electrical conductors being connected to a different one of the multiple terminals to cause an electric traveling wave to move in a longitudinal direction to induce pumping of liquid phase in the longitudinal direction to thereby enhance the thermal energy transfer characteristics of the thermal energy transfer system.

29. The system of claim 28, wherein the longitudinal direction is additionally perpendicular to a longitudinal axis of the electrical conductors.

30. The system of claim 28, wherein the plurality of electrical conductors are disposed spaced apart from the first surface of the at least one heat transfer member.

31. The system of claim 28, wherein the plurality of electrical conductors are spirally wound about the first surface of the at least one heat transfer member.

32. The system of claim 28, wherein the first surface of the at least one heat transfer member comprises an exterior surface of the at least one heat transfer member, and wherein a cooling medium is disposed in contact with an interior surface of the at least one heat transfer member, and wherein longitudinal pumping of the liquid phase enhances condensation of the fluid on the exterior surface of the at least one heat transfer member.

33. The system of claim 28, wherein the first surface of the at least one heat transfer member comprises an interior surface of the at least one heat transfer member, and wherein a cooling medium is disposed within the outer conduit surrounding the at least one heat transfer member, and wherein longitudinal pumping of the liquid phase enhances condensation of the fluid on the interior surface of the at least one heat transfer member.

34. The system of claim 28, wherein the first surface of the at least one heat transfer member comprises an interior surface of the at least one heat transfer member, and wherein a heating medium is disposed within the outer conduit and surrounding the at least one heat transfer member, and wherein longitudinal pumping of the liquid phase enhances vaporization of the fluid on the interior surface of the at least one heat transfer member.

35. The system of claim 28, wherein the first surface of the at least one heat transfer member comprises an exterior surface of the at least one heat transfer member, and wherein a heating member is disposed in contact with an interior surface of the at least one heat transfer member, and wherein longitudinal pumping of the liquid phase facilitates vaporization of the fluid on the exterior surface of the at least one heat transfer member.

36. The system of claim 28, wherein the power supply is operable to supply a phase varying voltage to each of the plurality of electrical conductors to induce longitudinal pumping of the liquid phase along the first surface of the at least one heat transfer member.

37. The system of claim 28, wherein the at least one heat transfer member is disposed above at least one other heat transfer member such that longitudinal pumping of the liquid phase substantially prevents the liquid phase from falling onto the at least one other heat transfer member.

38. The system of claim 28, wherein the plurality of electrical conductors are disposed along a portion of a length of the at least one heat transfer member.

39. The system of claim 28, wherein the plurality of electrical conductors comprises a plurality of electrical conductor rings disposed in a spaced apart relationship to each other and in parallel planes oriented transverse to the longitudinal axis of the heat transfer member.

40. The system of claim 28, wherein the plurality of electrical conductors comprises a plurality of insulated electrical conductors disposed in contact with the first surface of the at least one heat transfer member.

41. The system of claim 28, wherein the at least one inner heat transfer member is constructed having a substantially circular cross sectional configuration, and wherein the electrical conductors are disposed about a portion of a circumference of the at least one inner heat transfer member.

* * * * *